US006739738B1

(12) United States Patent
Smith

(10) Patent No.: US 6,739,738 B1
(45) Date of Patent: May 25, 2004

(54) METHOD AND APPARATUS FOR LIGHT REDISTRIBUTION BY INTERNAL REFLECTION

(75) Inventor: Todd J. Smith, Deep River, CT (US)

(73) Assignee: Whelen Engineering Company, Inc., Chester, CT (US)

( * ) Notice: Subject to any disclaimer, the term of this patent is extended or adjusted under 35 U.S.C. 154(b) by 0 days.

(21) Appl. No.: 10/352,499

(22) Filed: Jan. 28, 2003

(51) Int. Cl.[7] ..... F21V 5/00

(52) U.S. Cl. ..... 362/317; 362/331; 362/332; 362/235; 362/245; 362/326; 362/327; 362/328

(58) Field of Search ..... 362/317, 331, 362/332, 235, 244, 245, 237, 297, 307, 308, 346, 341, 326, 327

(56) References Cited

U.S. PATENT DOCUMENTS

| | | | | |
|---|---|---|---|---|
| 4,929,866 A | | 5/1990 | Murata et al. | 313/500 |
| 5,327,328 A | | 7/1994 | Simms et al. | 362/26 |
| 5,349,504 A | | 9/1994 | Simms et al. | 362/32 |
| 5,434,754 A | | 7/1995 | Li et al. | 362/31 |
| 5,833,355 A | | 11/1998 | You et al. | 362/244 |
| 5,897,201 A | * | 4/1999 | Simon | 362/268 |
| 6,295,405 B1 | | 9/2001 | Jannson et al. | 385/146 |
| 6,443,594 B1 | | 9/2002 | Marshall et al. | 362/244 |
| 6,476,970 B1 | | 11/2002 | Smith | 359/618 |
| 6,485,149 B1 | | 11/2002 | Berg et al. | 359/615 |
| 6,533,446 B2 | | 3/2003 | Chen et al. | 362/559 |

* cited by examiner

*Primary Examiner*—Sandra O'Shea
*Assistant Examiner*—. Tsidulko
(74) *Attorney, Agent, or Firm*—Alix, Yale & Ristas, LLP

(57) ABSTRACT

A method and apparatus are disclosed for redistributing light to shift the apparent position of light generation and provide a more uniform area of light emission from a light assembly incorporating a plurality of spaced-apart light sources. Divergent light from each light source is collimated into a beam. Portions of each beam are diverted from the direction of the beam, transmitted laterally and redirected to emerge from the light assembly radially spaced from the position of the light source producing the beam. An internal reflecting lens member molded from optical plastic is disclosed as one apparatus for carrying out the method. The disclosed method and apparatus are particularly applicable to light assemblies incorporating an array of LEDs.

19 Claims, 14 Drawing Sheets

METHOD AND APPARATUS FOR LIGHT REDISTRIBUTION BY INTERNAL REFLECTION

BACKGROUND OF THE INVENTION

1. Field of the Invention

The present invention relates to lenses for warning and signal lights and more particularly to lenses for redistribution of light from several light sources over the surface area of a signal or warning light 2. Description of the Related Art Relatively recent advances in the manufacture of light emitting diodes (LEDs) have made them an attractive light source for many purposes previously employing incandescent, halogen or strobe light sources. LED light sources have longer life, higher efficiency and are more durable than previous light sources. One complicating factor in the employment of LED light sources for many purposes is that the light output from several LEDs must be combined to equal the effective light output of a single light source of the type previously used.

It is known to use external lenses configured to refract light emitted from LED light sources into a desired pattern where the light from each LED is redirected to overlap with that of other LEDs in the array to form a desired pattern. Another approach is to fill the surface area for a warning or indicator light with a plurality of outward-facing LEDs. This approach effectively fills the surface area of the warning or indicator light with a relatively uniform light output. Using many LEDs partially defeats the efficiency advantages of an LED by employing more LEDs than would be necessary if the LEDs' light output were more effectively harnessed. Using many LEDs also complicates design of the light by employing a dense array of LEDs in which heat removal becomes an issue.

An alternative approach is to use a reflector to combine and redirect the light output of a plurality of LEDs. Combining the light output of a plurality of LEDs in a reflector is effective for many warning and signaling purposes. However, there are warning and signal light applications in which the configuration of the necessary warning or indicating light and/or its mounting location is not conducive to use of a reflector.

There is a need in the art for novel and versatile means for redistributing the light from a plurality of LEDs to provide a more uniform fill over the surface area of a warning or signaling light. Uniform light emission may be required comply with standards imposed by governmental agencies for particular warning or signaling purposes. Improved uniformity of light emission may also be desirable for aesthetic purposes.

SUMMARY OF THE INVENTION

Briefly stated, a first exemplary embodiment of the present invention comprises a lens member that uses internal reflection to redistribute light from an array of LEDs into a more uniform pattern of light emission. The lens includes collimators positioned to receive the divergent light produced by each LED and redirect that divergent light into a substantially collimated beam. An exemplary embodiment of the collimator is a cone-like configuration of refractive plastic that produces a circular collimated beam which is symmetrically distributed around and parallel to the optical axis of each LED light source.

According to a further aspect of the invention, a first group of internal lens surfaces are arranged to reflect a portion of each collimated beam toward an area of the light assembly which does not include an LED light source and would otherwise present an area of reduced light output. This first group of internal lens surfaces has an angular orientation relative to the collimated beam calculated to redirect the reflected light to a path substantially perpendicular to the optical axis of the LED. The internal lens surfaces are also configured to impart a directional component to the intercepted light in a plane substantially perpendicular to the optical axis of the LED such that the intercepted light is directed toward an area of the warning or signal light lacking a light source. The shape and angular orientation of the first group of internal lens surfaces are dependent upon the distribution of LEDs in the array as well as the overall shape of the warning or signal light.

In accordance with a further aspect of the present invention, a second group of internal lens surfaces is positioned to redirect light from the first group of internal lens surfaces into a path substantially parallel to the path of the LED optical axis/collimated beam. The angular orientation and shape of this second group of internal lens surfaces is related to the shape of the warning or signal light and cooperates with the shape and orientation of the first group of internal lens surfaces. A portion of the light output of each LED light source is redistributed from a collimated beam immediately surrounding the optical axis of the LED to an area of the light assembly that would otherwise present an area of reduced light emission. Areas of reduced light emission, or dark spots, aside from being aesthetically unattractive, may not be permitted by the applicable standard regulating warning and signal lights.

An object of the present invention is to provide a new and improved means for redistributing the light output from a plurality of LEDs over the surface area of a warning or indicating light.

Another object of the present invention is to provide a new and improved method for redistributing light from a plurality of LEDs over the surface area of a warning or signaling light that improves the efficiency and versatility of light sources employing the lens.

BRIEF DESCRIPTION OF THE DRAWINGS

These and other objects, features, and advantages of the invention will become readily apparent to those skilled in the art upon reading the description of the preferred embodiments, in conjunction with the accompanying drawings, in which.

DETAILED DESCRIPTION OF THE PREFERRED EMBODIMENT

The invention will now be described in greater detail in the context of three exemplary embodiments. A first exemplary embodiment, illustrated in FIGS. 1–8C employs an internal reflecting lens 10 to improve the uniformity of light emitted from a circular light assembly 200. The second exemplary embodiment 10*a,* illustrated in FIGS. 9–13 adds internal reflecting surfaces 18, 20 to the internal reflecting surfaces of FIGS. 1–8C to improve wide-angle light emission from a light assembly employing the lens. FIGS. 14–18 illustrate an internal reflecting lens 10*b* configured to improve the uniformity of light output from a rectangular light assembly. It will be appreciated that light redistribution in a circular light assembly requires a somewhat different approach than light redistribution in a rectangular light assembly.

Figure 1:
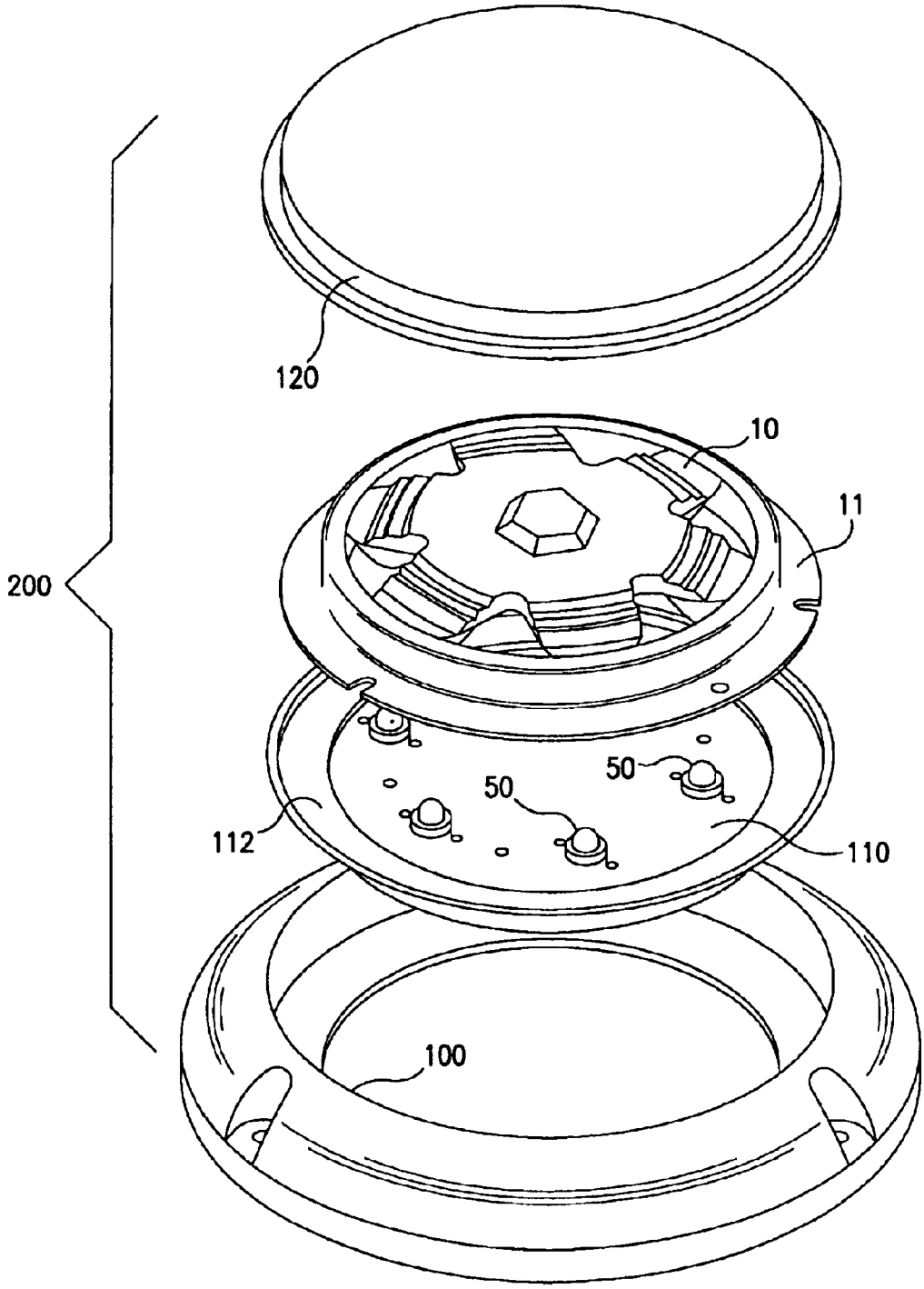
FIG. 1 is a top perspective view of a light assembly Incorporating an internal reflecting lens exemplary of several aspects of the present invention.
Figure 2:
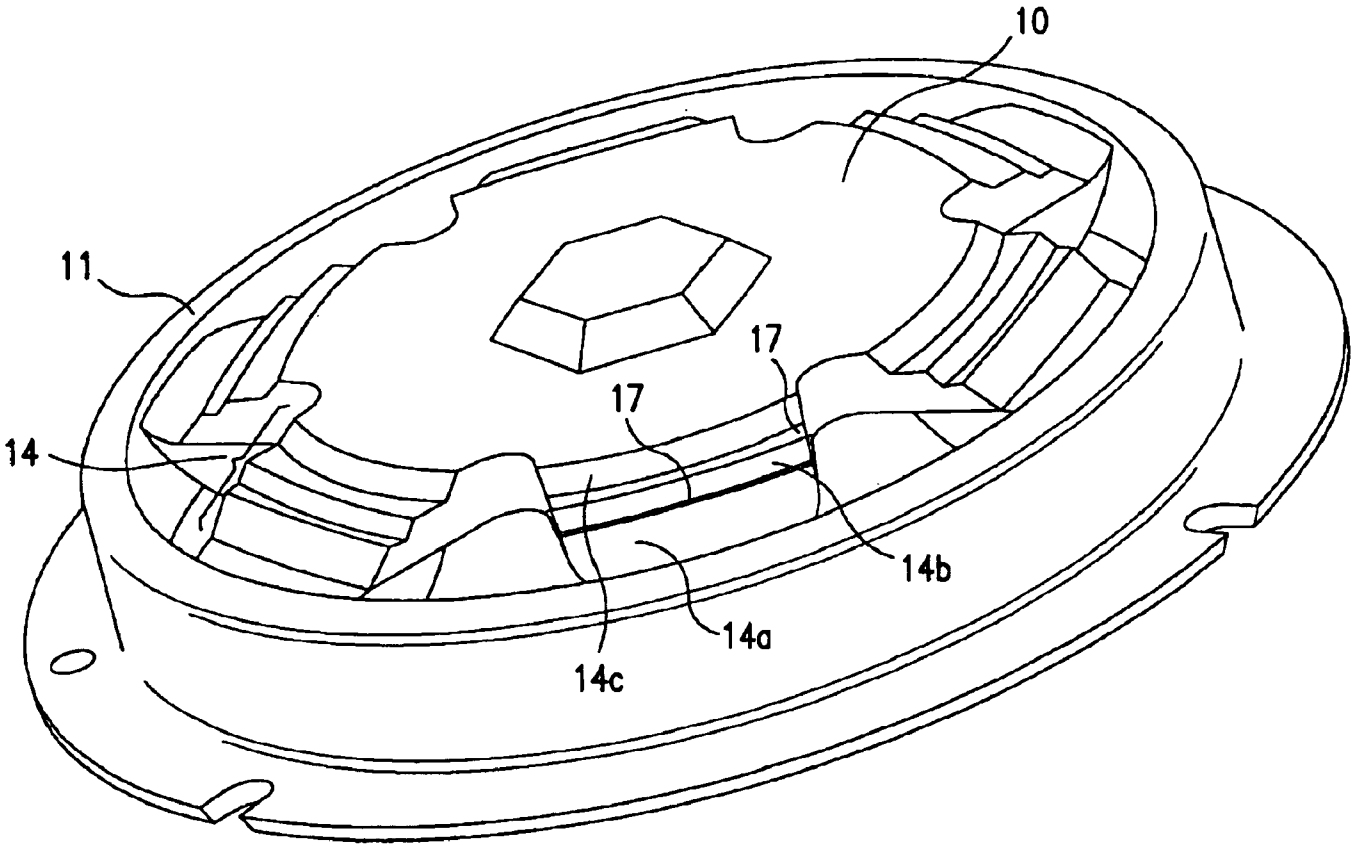
FIG. 2 is a top perspective view of the internal reflecting lens shown in the light assembly of FIG. 1.

As shown in FIG. 1, an exemplary round light assembly 200 comprises a circular trim piece 100 for mounting to the exterior of a motor vehicle, trailer or other apparatus requiring a warning or signal light. A PC board 110 carrying a plurality of LED light sources 50 is secured within a thermally transmissive plastic frame 112. An internal reflective lens 10 in accordance with the present invention is secured to the frame 112 and the trim piece 100 by a circular flange 11 integrally molded with the lens 10. Finally, an external lens 120 provides protection, color filtering (if necessary) and light-pattern shaping (if desired).

The exemplary light assembly 200 of FIG. 1 employs a circular array of six high-output LEDs 50. The LEDs 50 may be, for example, one-watt or five-watt Luxeon™ Emitters manufactured by Lumileds Lighting, LLC of San Jose Calif. Fewer high-output LEDs are required to generate a required light output when compared with lower output LEDs. A smaller number of LEDs spread over the surface area of a light assembly increases the likelihood that some parts of the light assembly will become areas of reduced light emission, or dark patches. The present invention provides a means for redistributing part of the output of each LED from an area of the light assembly immediately in front of the LED to an area of the light assembly that would otherwise appear dark.

Figure 3:
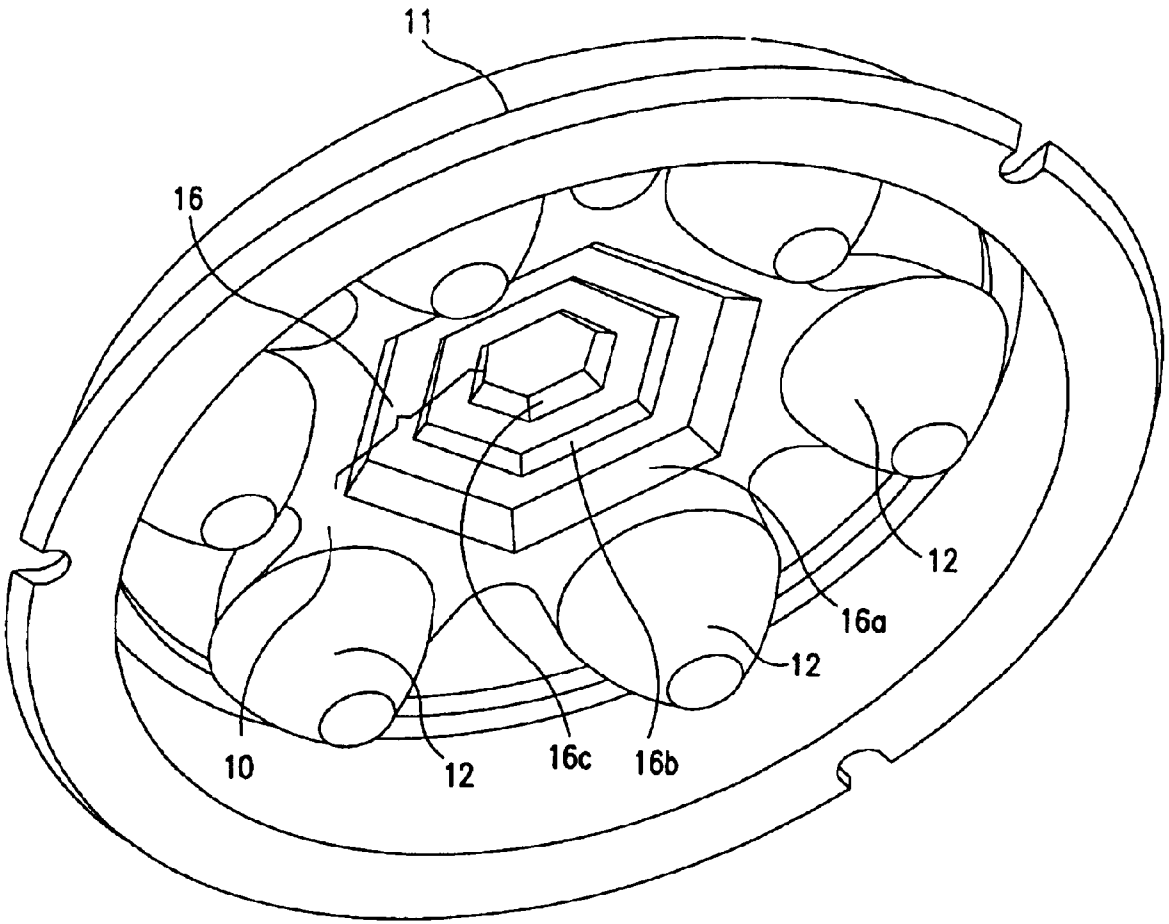
FIG. 3 is a bottom perspective view of the internal reflecting lens of FIG. 2.

FIG. 3 is a bottom view of the internal reflecting lens 10 showing six collimators 12 arranged to receive the light output from the is six LEDs 50. Each collimator 12 converts the divergent light output 80 of an LED 50 into a substantially collimated beam 81 travelling in a path parallel to the optical axis A of the LED. If this light output pattern were not altered, there would be a dark patch of reduced light emission in the middle of the light assembly surrounded by a ring of bright light emission. This dark patch is only partially correctable by a refractive outer lens. A refractive outer lens alters the direction of light leaving the light assembly but does not change the apparent point of light generation. Use of a refractive lens would make the LED light sources appear as blurred points of light separated by dark patches. The present invention alters the apparent point of light generation by using internal reflection to form a "light pipe" within the lens.

Figure 4:
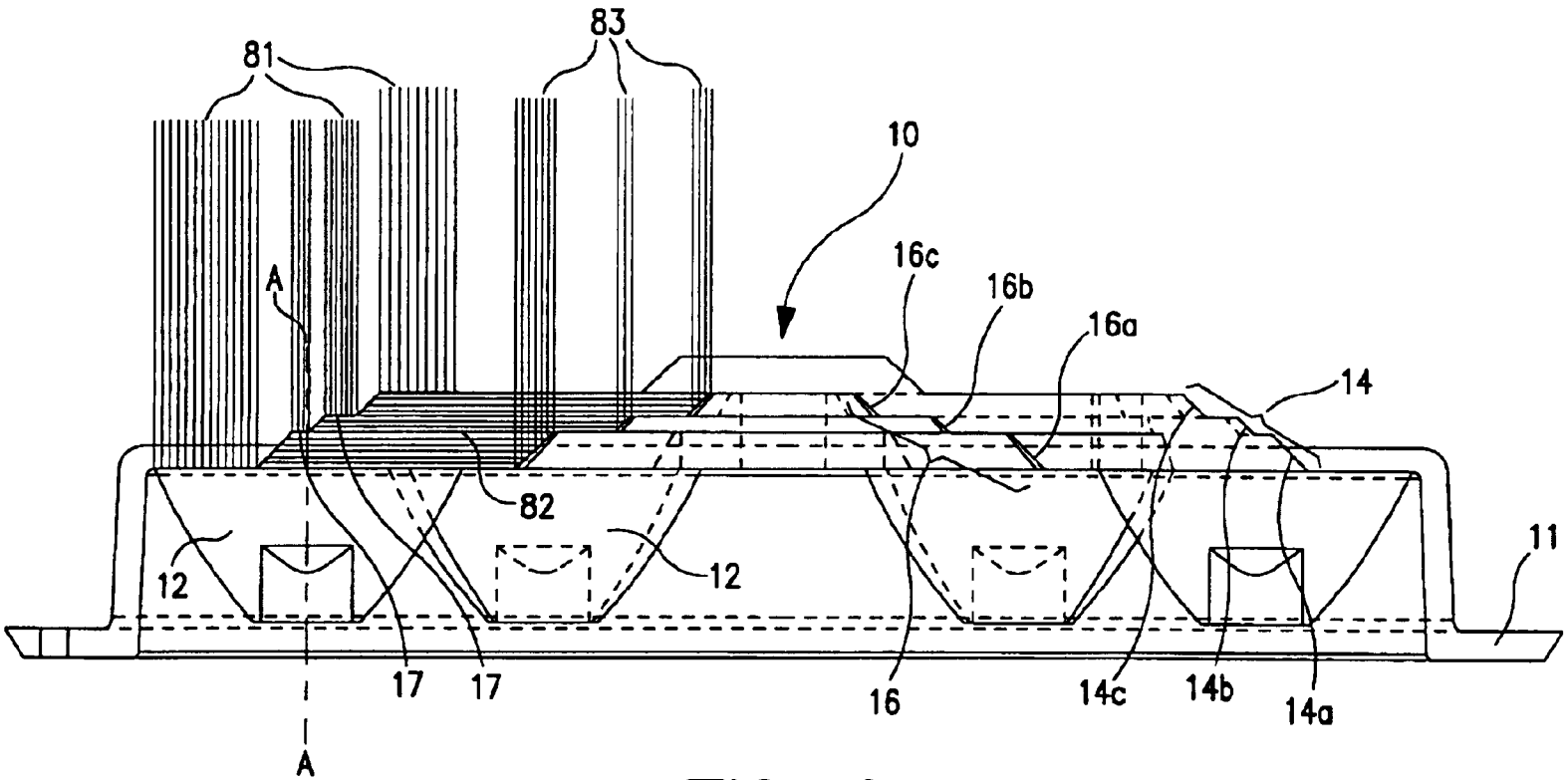
FIG. 4 is a sectional view through the internal reflecting lens of FIGS. 2 and 3, partly in phantom.
Figure 5:
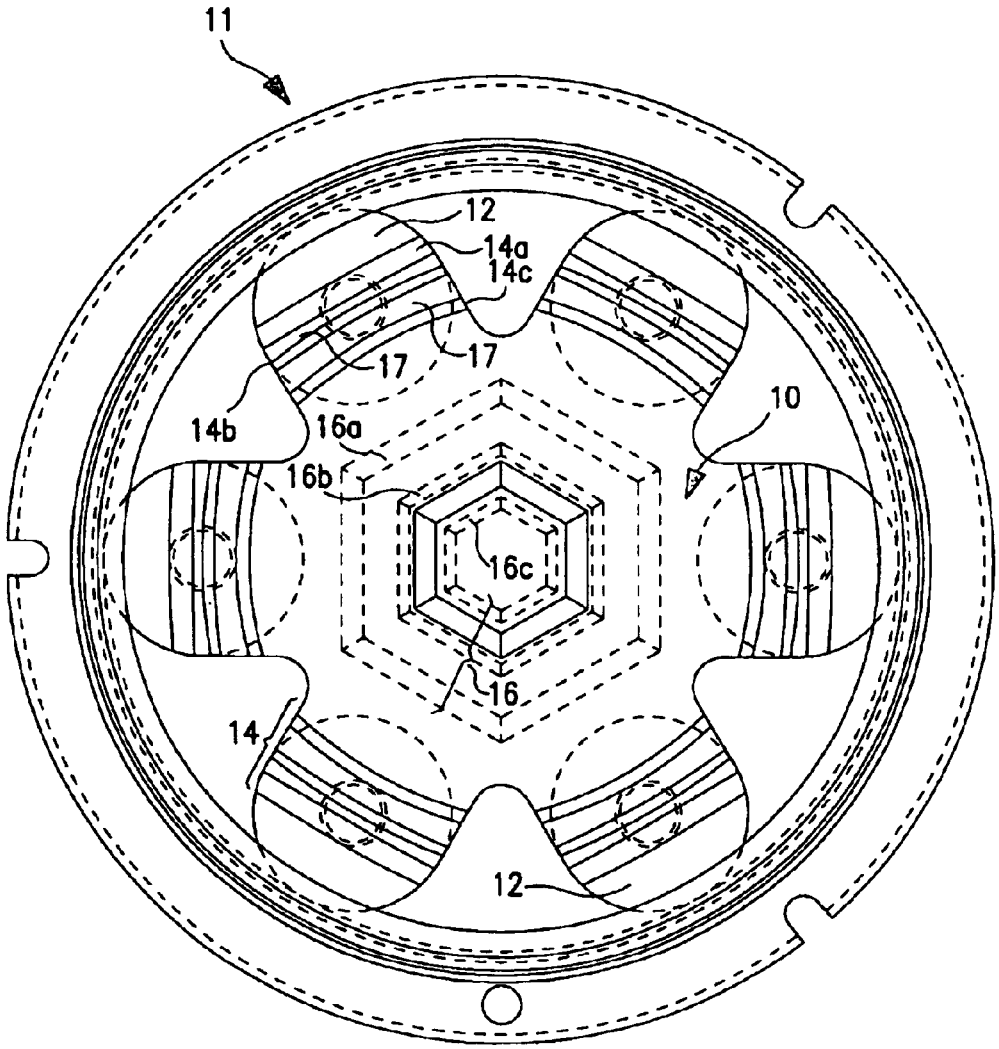
FIG. 5 is a top plan view, partly in phantom, of the internal reflecting lens of FIGS. 2 and 3.
Figure 6:
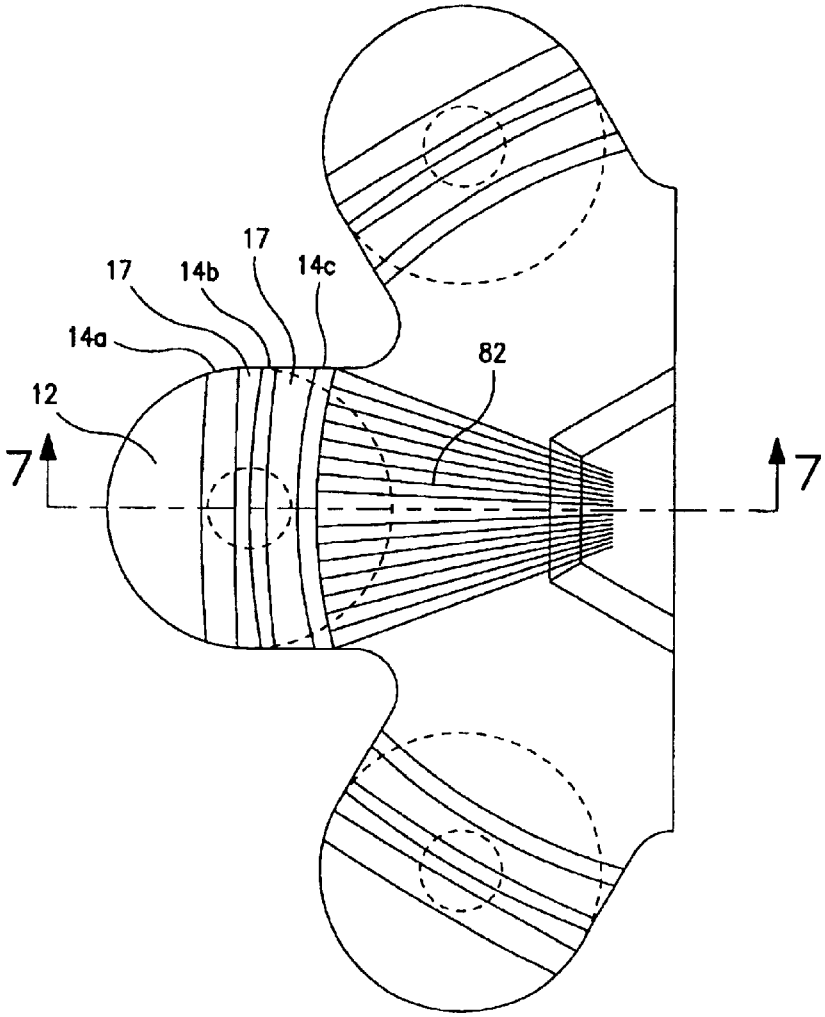
FIG. 6 is a partial top plan view of an internal reflecting lens exemplary of several aspects of the present invention.
Figure 7:
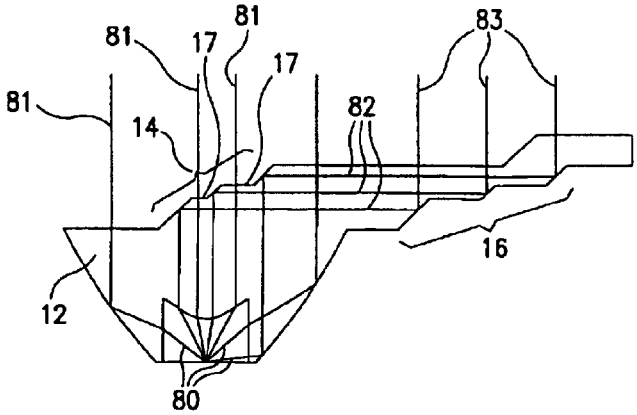
FIG. 7 is a sectional view through the internal reflecting lens of is FIG. 6, taken along line 7—7 thereof.

With particular reference to FIGS. 4–7, a first exemplary internal reflecting lens 10 for a round light assembly diverts a portion of each collimated beam by positioning a first group of three internal surfaces 14*a,* 14*b,* 14*c* in the path of the collimated beam produced by each collimator 12 (see FIGS. 4 and 7). In the first exemplary embodiment, the three internal surfaces 14*a,* 14*b,* 14*c* are separated by lens portions 17 that permit some of the collimated beam to continue along a path parallel with the optical axis A of the LED.

As can be seen from FIGS. 5–8C, each of the first group of three internal lens surfaces 14*a,* 14*b,* 14*c* may have a different width $W_a$, $W_b$, $W_c$ measured parallel to is angular orientation θ. The width $W_c$ of surface 14*c* is greater than the width $W_b$ of surface 14*b,* resulting in a larger reflecting surface area. It will be apparent that a larger reflecting lens surface area will divert a greater portion of the collimated beam than an internal lens surface having a smaller area. The dimensions, position and spacing of the first group of internal lens surfaces 14 determine how much of each collimated beam 81 is diverted and how much of each collimated beam 81 is allowed to continue along a path parallel with the optical axis A of each LED. If the goal of the internal reflecting lens is to improve the uniformity of light output from the light assembly, it will be appreciated that a portion of each collimated beam should be permitted to continue along its path.

FIG. 7 is a sectional view through one half of the exemplary circular internal reflecting lens 10 taken along a radius of the lens passing through the center of a collimator 12 (line 7—7 of FIG. 6). Light 80 generated by an LED are shown emerging in a divergent pattern from the die of an LED. The collimator 12 converts the divergent light 80 into a substantially collimated beam 81. Portions of the collimated beam are intercepted by the first group of internal lens surfaces 14 (see FIGS. 4 and 7). The first group of internal lens surfaces 14 has an angular orientation θ relative to the path of the collimated beam that results in the intercepted light being reflected along a path substantially perpendicular or approximately 90° relative to the path of the collimated beam 81. In the illustrated lens 10, θ is substantially equal to 45°. Although not illustrated, it will be understood that light redistribution may be carried out by diverting light at angles other than 90° relative to the collimated beam 81 by using internal lens surfaces having an orientation θ other than 45°. Such a configuration would be useful in situations where the central portion of the lens is not substantially planar as in the exemplary lens 10.

Figure 8C:
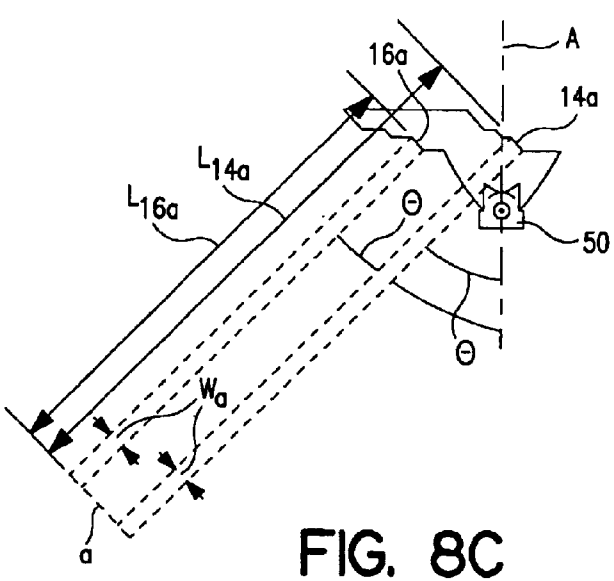
FIGS. 8A–8C are partial sectional views of an internal reflecting lens exemplary of several aspects of the present invention.
Figure 8B:
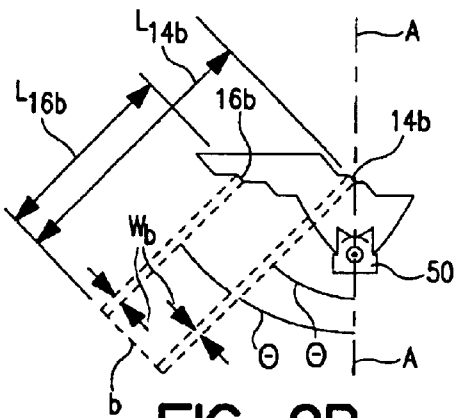
Figure 8A:
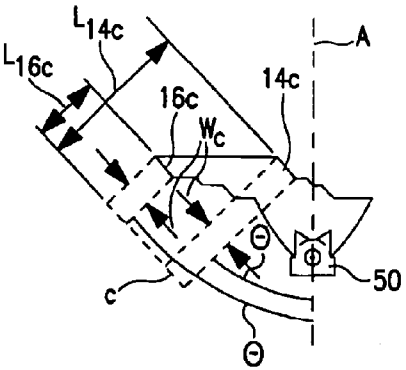
Figure 9:
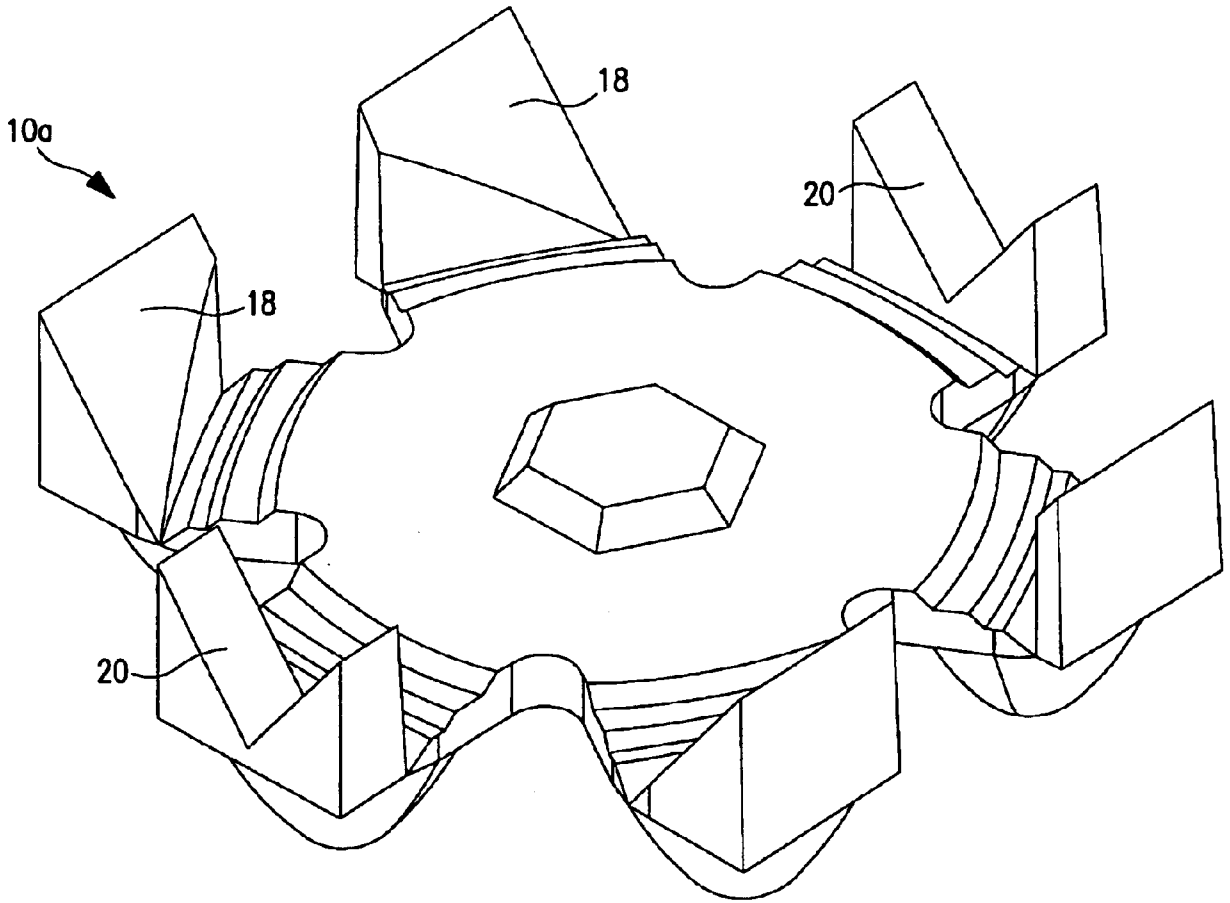
FIG. 9 is an exterior perspective view of an alternative embodiment of an internal reflecting lens exemplary of further aspects of the present invention.
Figure 10:
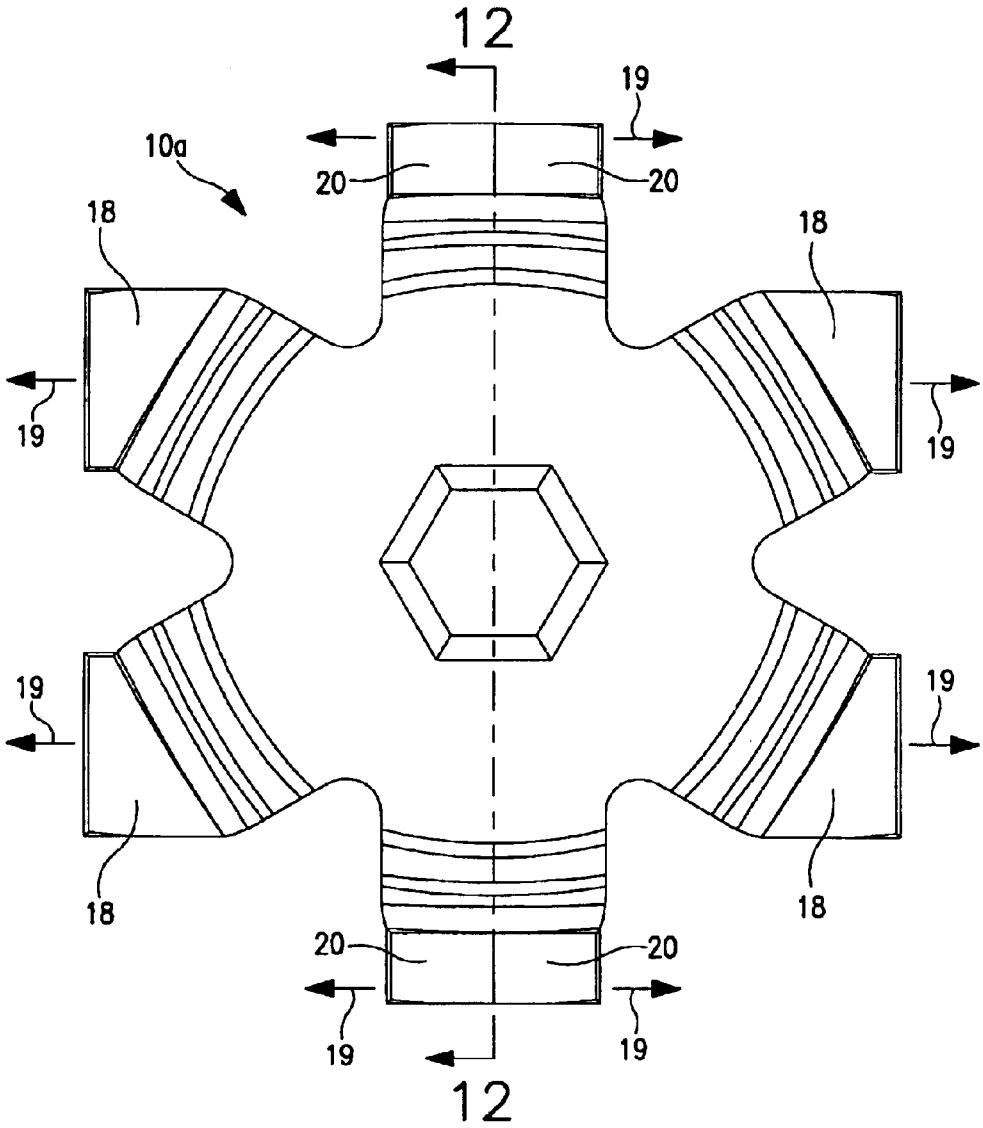
FIG. 10 is a top plan view of the internal reflecting lens of FIG. 9.
Figure 11:
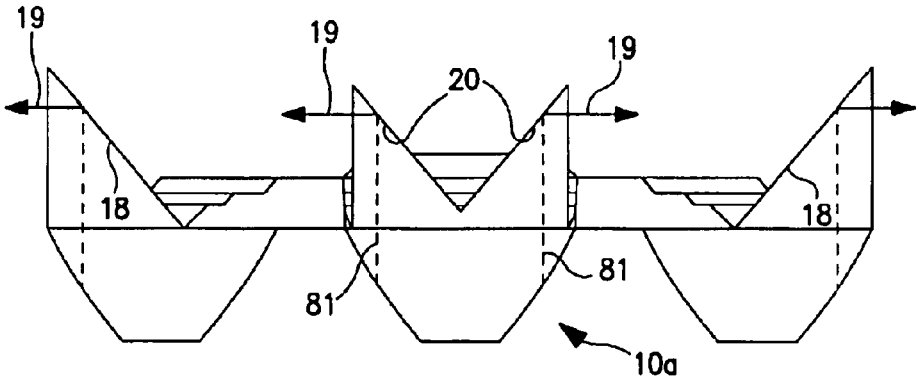
FIG. 11 is a side plan view of the Internal reflecting lens of FIG. 10, taken from above.
Figure 12:
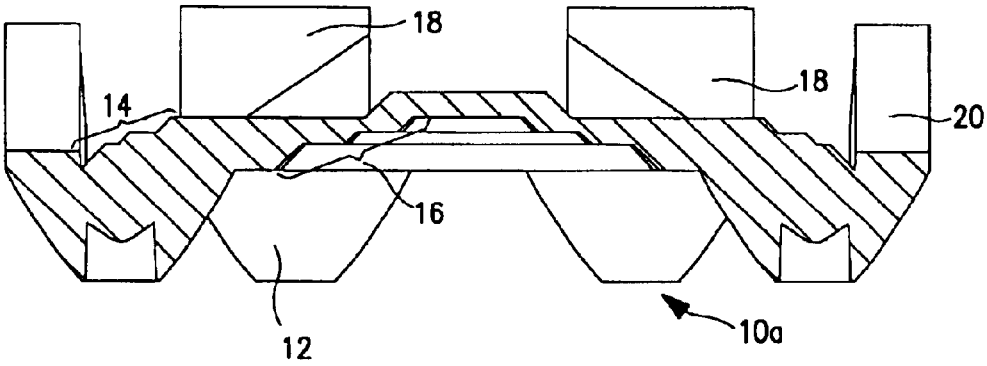
FIG. 12 is a sectional view through the Internal reflecting lens of FIG. 10, taken along line 12—12 thereof.
Figure 13:
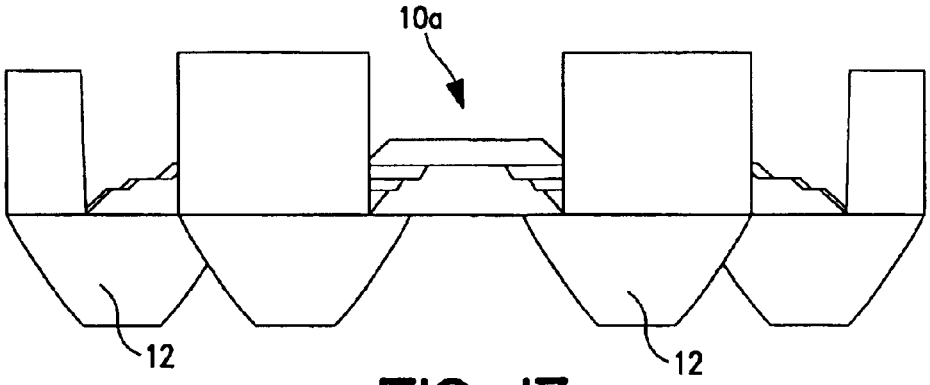
FIG. 13 Is a side plan view of the internal reflecting lens of FIG. 10, taken from the right.

In the exemplary internal reflecting lens 10, the first group of internal lens surfaces 14 is configured to direct the intercepted light 82 toward the center of the light assembly 200. The first group of internal reflecting surfaces are curved so that the intercepted light 82 converges as it approaches the center of the lens 10 (see FIG. 6). Each of the three internal lens surfaces 14*a,* 14*b,* 14*c* has a different curvature defined by a central portion of a parabola, although other curves or faceted shapes may also be effective. As best illustrated in FIGS. 8A–8C, the focal length D of the parabola used to define the curvature of the first group of internal lens surfaces 14 increases as the internal lens surfaces progress radially outwardly toward the periphery of the lens. The curvature of each of the surfaces is calculated to reflect the light in a is converging pattern within a 60° sector of the lens (see FIG. 6). This configuration corresponds to an array of six LEDs 50 in a circular light assembly 200. Differing numbers of LEDs and shapes of light assemblies will, of course, employ alternative surface configurations.

Thus, a portion of each collimated beam 81 is transported radially inwardly within the internal reflecting lens 10 toward the center of the light assembly 200. A second group of internal lens surfaces 16 is arranged to redirect this laterally transmitted light 82 into a path substantially parallel to the optical axes of the LEDs. In the exemplary lens 10 for a circular LED array, the second group of internal reflecting surfaces 16 have a parabolic curvature calculated to straighten the converging light rays received from the corresponding first group of internal reflecting surfaces 14. Each of the reflecting surfaces in the first group 14 cooperates with reflecting surface in the second group 16 having a complementary configuration. FIG. 8A illustrates that the focal points of the parabola defining the curvature of reflecting surface 14*c* and the parabola defining the curvature of reflecting surface 16*c* are positioned on a line c perpendicular to parallel planes containing the parabolas. This relationship has proven to result In the desired redirection of the transported light 82 into a path parallel to the collimated beams 81 and the optical axes A of the LEDs 50. FIGS. 8B and 8C illustrate that this relationship is maintained in the other complementary pairs of reflecting surfaces 14*b,* 16*b* and 14*a,* 16*a.*

The complementary parabolic configurations of the first and second groups of internal reflecting surfaces produce light that emerges from the front of the internal reflecting lens in a substantially collimated arrangement. In other words, the majority of the light emerging from a lens in accordance with the present invention will be oriented parallel to the optical axes A of the LEDs. Each of the six 60° sectors of the internal reflecting lens 10 are identical and include a collimator 12, first group of internal reflecting surfaces 14 and complementary second group of internal reflecting surfaces 16. Internal reflection within the lens 10 shifts the apparent point of light generation toward the center of the light assembly 200.

The internal reflecting lens may be understood as a light pipe for transmitting a portion of the light produced by an array of LEDs 50 toward an area of a light assembly that would otherwise present an area of diminished light emission. In the first exemplary light assembly 200, the peripheral array of LEDs 50 permits an LED spacing that enhances ease of manufacture and allows ample surface area for removal of heat. The illustrated array is made possible by advances in LED technology. Six high-output LEDs 50 generate light sufficient to meet the requirements for what is known in the art as a Par 36 signal light. Applicable standards specify not only the overall quantity of light but that the light be emitted uniformly over the surface area of the light. The internal reflecting lens 10 redistributes the light output from the six LEDs 50 into a more uniform, collimated light-emission pattern to meet this standard. This uniform collimated light pattern may now be provided with a clear or colored lens configured to focus, diffuse, laterally spread or vertically spread the available light to suit a particular purpose and Installation orientation.

FIGS. 9–13 illustrate a further embodiment of internal reflecting lens for a round (Par 36) light assembly in which the radially outward portions of each collimator 12 are provided with internal reflecting surfaces 18, 20. These reflecting surfaces 18, 20 reflect light incident upon them generally perpendicular to the path of the collimated beams produced by the collimators. This arrangement provides enhanced wide-angle visibility for a light assembly employing the lens 10*a* when it is installed in the orientation illustrated in FIG. 10. The arrows 19 indicate the path of light from the reflecting surfaces 18, 20 to the right and left of the lens 10*a.* Wide-angle visibility is desirable and may be specifically required in vehicular warning and signaling lights. The illustrated lens configuration provides an enhanced light pattern to the left and right of a light assembly equipped with lens 10*a.* With the exception of the addition of reflecting surfaces 18, 20, lens 10*a* illustrated in FIGS. 9–13 is structurally and functionally identical to that discussed with reference to FIGS. 2–8C.

Figure 14:
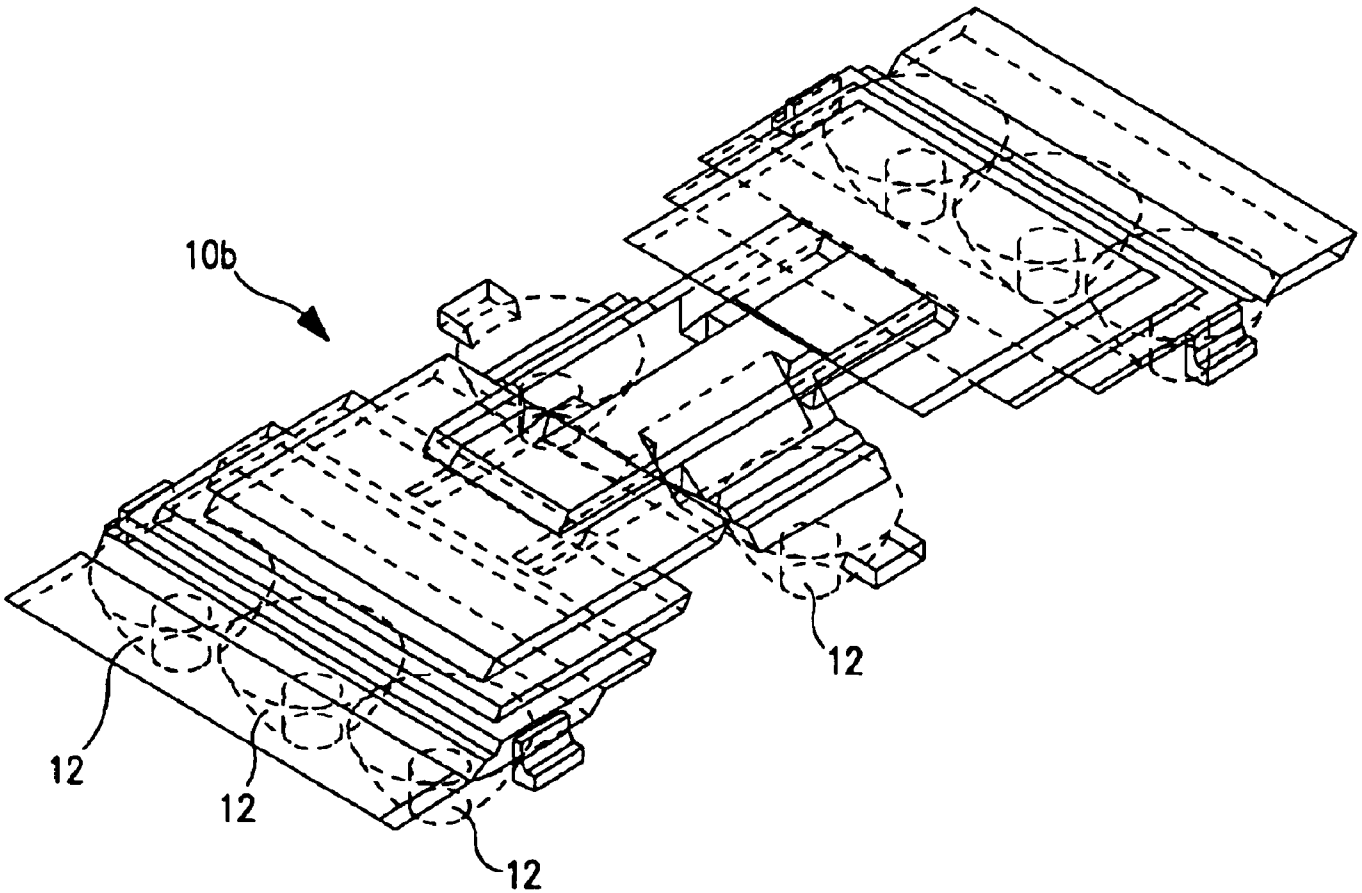
FIG. 14 is a perspective top view, partly In phantom, of a further embodiment of internal reflecting lens exemplary of aspects of the present invention.
Figure 15:
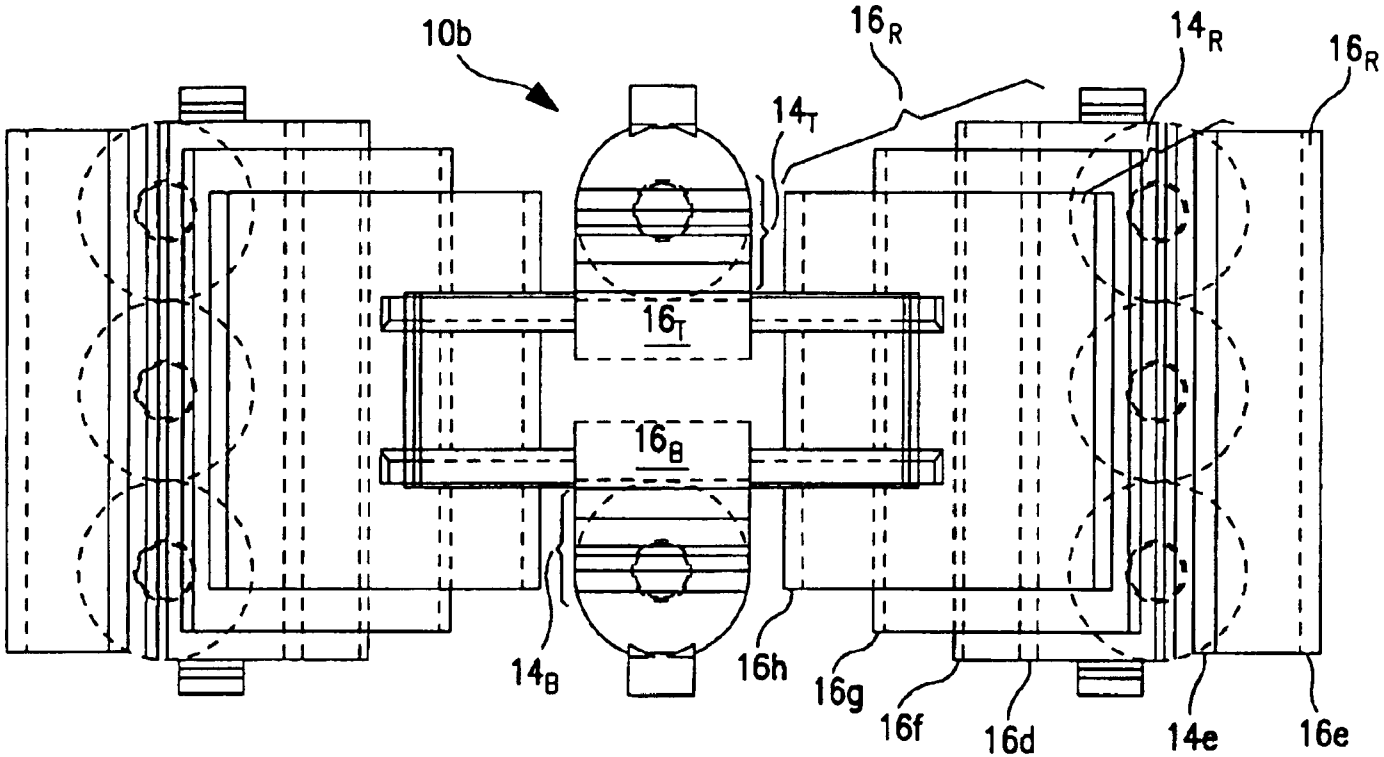
FIG. 15 is a top plan view, partly in phantom, of the internal reflecting lens of FIG. 14.
Figure 16:
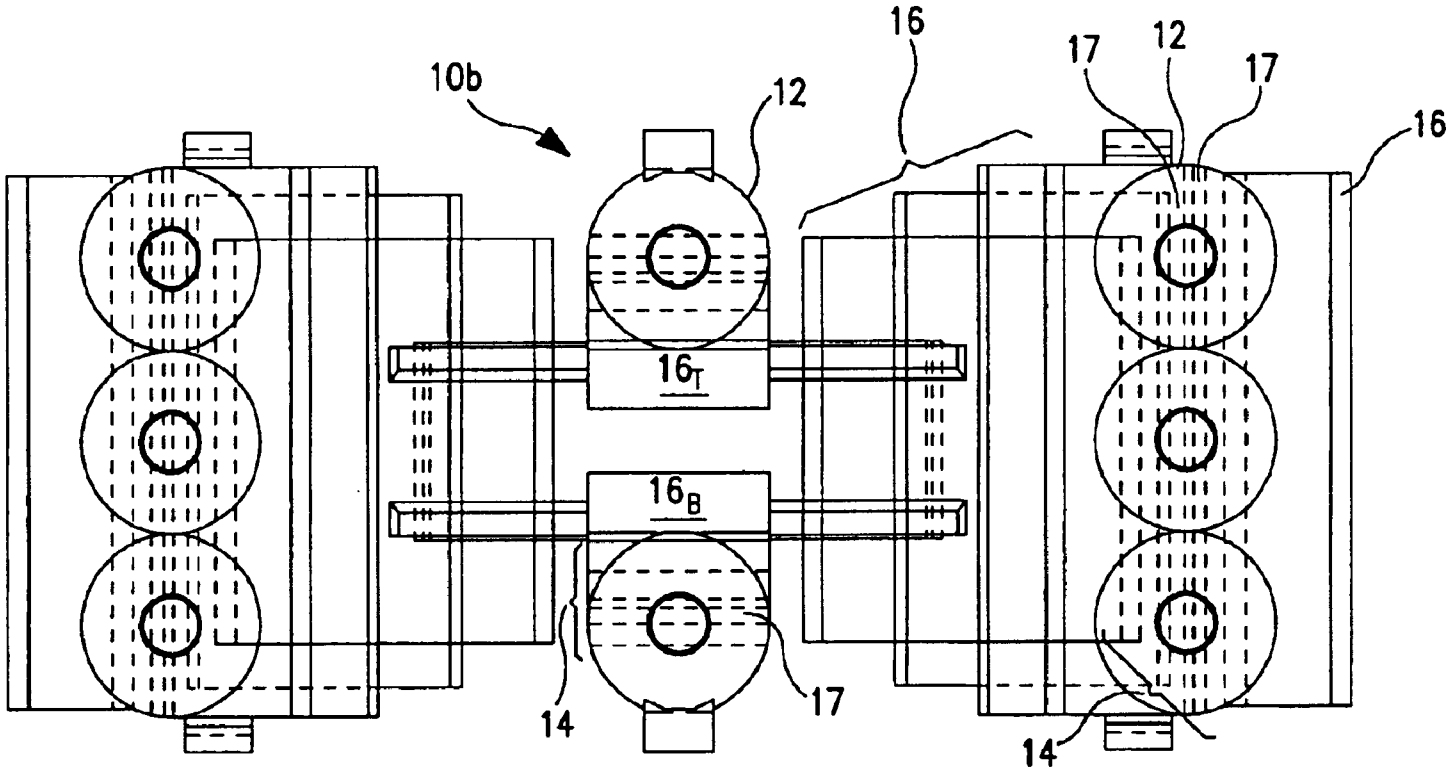
FIG. 16 is a bottom plan view, partly in phantom, of the internal reflecting lens of FIG. 14.
Figure 17:
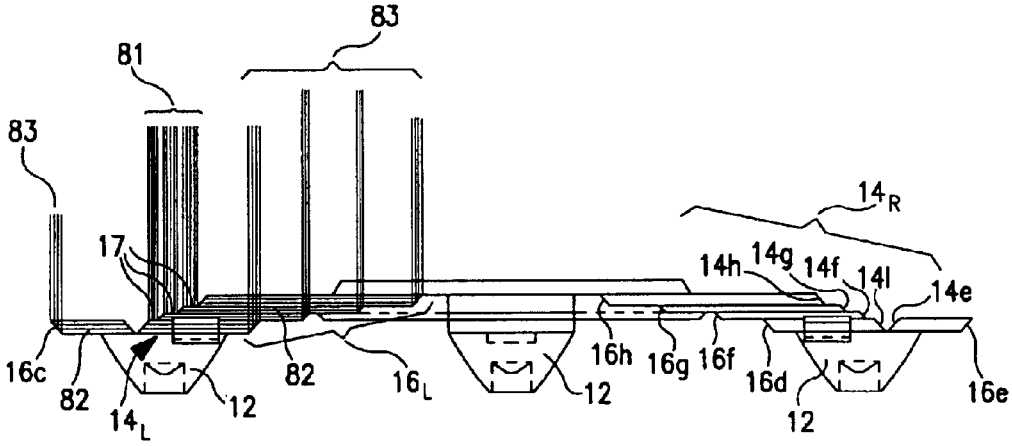
FIG. 17 is a right side plan view, partly in phantom, of the internal reflecting lens of FIG. 14.
Figure 18:
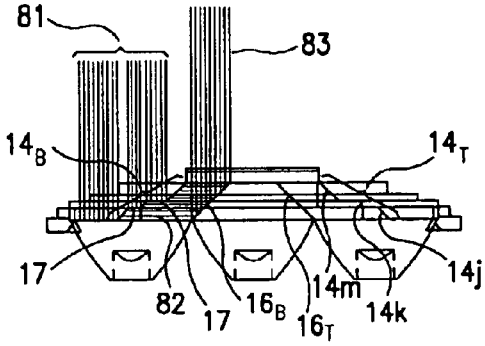
FIG. 18 is a left end plan view, partly in phantom, of the internal reflecting lens of FIG. 14.

Internal reflection within a lens in accordance with aspects of the present invention may also be used to redistribute light in light assembly configurations other than circular. FIGS. 14–18 illustrate an internal reflecting lens embodiment 10*b* for use in conjunction with a rectangular light assembly. Internal reflecting lens 10*b* is configured to redistribute the light output from a rectangular array of eight LEDs. The internal reflecting lens 10*b* is configured for mounting over the rectangular array of LEDs such that the collimators 12 are arranged substantially along the optical axis of each LED. The collimators 12 are configured and function substantially identically to those described previously. First and second groups of internal reflecting surfaces 14, 16 are arranged to intercept portions of the collimated beam 81 produced by each collimator 12 and redirect the intercepted light 82 into a path substantially perpendicular to the collimated beam 81. As in the previously described internal reflecting lenses 10, 10*a,* a first group of internal reflecting surfaces 14 is arranged to intercept portions of the collimated beam 81 from each collimator 12. The surfaces in the first group have an angular orientation θ relative to the beam 81 of approximately 45°. As best seen in FIGS. 14–16, there are four distinct first groups of surfaces $\mathbf{14}_R$, $\mathbf{14}_L$, $\mathbf{14}_T$, and $\mathbf{14}_B$. Left and right first groups $\mathbf{14}_R$ and $\mathbf{14}_L$ are positioned to intercept light from the laterally outward rows of three collimators 12. These left and right groups $\mathbf{14}_R$, $\mathbf{14}_L$ are mirror images of each other and each include surfaces 14*d,* 14*f,* 14*g,* and 14*h* arranged to divert light toward the center of the lens 10*b.* Surface 14*e* is positioned to divert light from the laterally outward row of three collimators 12 away from the center, or toward the outer end of the lens 10*b.* Top and bottom first groups $\mathbf{14}_T$ and $\mathbf{14}_B$ are arranged to divert light from the upper and lower of the middle two collimators, respectively, toward the center of the lens 10*b.* As best seen in FIG. 18, each of the top and bottom first groups comprise three surfaces 14*j,* 14*k* and 14*m* oriented at an angle of 45° relative to the collimated beam 81.

Each of the first groups of reflecting surfaces $\mathbf{14}_R$, $\mathbf{14}_L$, $\mathbf{14}_T$, $\mathbf{14}_B$ has a corresponding second group of reflecting surfaces $\mathbf{16}_R$, $\mathbf{16}_L$, $\mathbf{16}_T$, $\mathbf{16}_B$. Each of the second groups of reflecting surfaces is positioned and oriented to redirect light from the corresponding first group to a direction parallel to the collimated beams 81. Second group $\mathbf{16}_R$ includes surfaces 16*d,* 16*e,* 16*f,* 16*g* and 16*h* positioned to redirect light received from corresponding first group surfaces 14*d*, 14*e*, 14*f*, 14*g* and 14*h*. Second group $\mathbf{16}_L$ is a mirror image of second group $\mathbf{16}_R$. In the illustrated embodiment 10*b*, the length of the second group reflecting surfaces 16*g* and 16*h* decreases toward the center of the lens because the center top and center bottom areas of the lens do not need light reinforcement.

Second group reflecting surfaces $\mathbf{16}_T$ and $\mathbf{16}_B$ vary from the pattern of the previous complementary reflecting surfaces by being in the form of a single surface arranged to receive and redirect light from all three surfaces of the corresponding first group 14*j*, 14*k* and 14*m*. The result is a large patch of collimated light 83 emitted from the upper and lower center of the lens 10*b* as best seen in FIG. 18.

It will be apparent that a common method is employed in configuring each of the above-discussed internal reflecting lenses 10, 10*a* and 10*b*. First, a collimator is arranged over each LED to convert divergent light from the LED into a substantially collimated beam 81. Second, at least one Internal reflecting surface is arranged to intercept a portion of the collimated beam 81. The internal reflecting surface is configured to direct the intercepted light substantially perpendicular to the path of the collimated beam toward an area of the light assembly that does not include an LED light source and would otherwise present an area of reduced light emission. A corresponding second internal reflecting surface having a substantially parallel angular orientation is arranged to redirect light reflected from the first internal reflecting surface to a path substantially parallel to that of the collimated beam. The inventive method utilizes internal reflection within a lens to redistribute light from an array of LEDs into a more uniform, substantially collimated light output.

In accordance with the present invention, a reduced number of high-output LEDs may be employed in warning and signaling lights where applicable standards require a substantially uniform pattern of light emission over the surface area of the light assembly. The inventive, internal reflecting lens reduces the number of LEDs necessary for a particular light assembly, eases manufacture by allowing the LEDs to be more widely spaced. LED spacing also improving the ease with which heat produced by each LED is dispersed.

Each of the foregoing internal reflecting lens embodiments 10, 10*a*, 10*b* may be efficiently produced by molding from optical grade plastic as is known in the art. Light redistribution by internal reflection in accordance with aspects of the present invention enhances the flexibility of LED warning and signal light design by allowing low profile, uniform fill light assemblies employing reduced numbers of high output LEDs.

The disclosed embodiments use internal reflection within a plastic lens member to collimate and redistribute light generated by a light source. It is also possible to use a combination of conventional reflection and internal reflection to accomplish a similar redistribution. For example, a conventional parabolic reflective surface may be employed to collimate light from the light source into a substantially collimated beam. A first, external lens surface would then be arranged to refract light into a path travelling radially away from the light source and within a lens member. A second, internal lens surface could then be arranged to redirect the light to emerge from the lens member at a position radially spaced from the light source.

The foregoing invention has been discussed in the context of several preferred embodiments, which should not be considered a limitation of the invention disclosed herein. Various modifications, adaptations and alternatives may occur to one skilled in the art without departing from the spirit and the scope of the present invention.

What is claimed is:

1. A method for redistributing light by internal reflection within a lens comprising the steps of:

receiving divergent light from a light source into a lens, said light source having an optical axis and a generally symmetrical light radiation pattern;

converting the divergent light into generally collimated light within the lens by internal reflection, said generally collimated light symmetrically distributed about said optical axis and having a first direction generally parallel to said optical axis;

diverting a first portion of said generally collimated light from said first direction to a second direction by internal reflection within the lens, while permitting a second portion of said generally collimated light to continue in said first direction;

redirecting said first portion from said second direction to a third direction by internal reflection within the lens, said third direction being generally parallel to said first direction, whereby said first portion is emitted from the lens at a position radially displaced from said second portion and the optical axis of the light source.

2. The method of claim 1, wherein said step of diverting comprises:

arranging a first internal lens surface to reflect said first portion, said first internal lens surface having an angular orientation relative to said first direction such that said first portion is reflected generally perpendicular to said first direction.

3. The method of claim 2, wherein said first internal lens surface is planar.

4. The method of claim 2, wherein said first internal lens surface is curved.

5. The method of claim 4, wherein said curved first internal lens surface has a curvature defined by a portion of a parabola.

6. The method of claim 1, wherein said step of diverting comprises:

arranging a plurality of first internal lens surfaces to reflect said first portion, each of said plurality of first internal lens surfaces separated from an adjacent of said plurality of first internal lens surfaces by a lens portion which permits some of said second portion of said generally collimated light to continue in said first direction, each of said plurality of first internal lens surfaces having an angular orientation relative to said first direction such that said first portion is reflected generally perpendicular to said first direction.

7. The method of claim 1, wherein said step of redirecting comprises:

arranging a second internal lens surface to reflect said first portion from said second direction to said third direction, said second internal lens surface having an angular orientation relative to said second direction such that said first portion is reflected generally perpendicular to said second direction.

8. The method of claim 7, wherein said second internal lens surface is planar.

9. The method of claim 7, wherein said second internal lens surface is curved.

10. The method of claim 9, wherein said curved second internal lens surface has a curvature defined by a portion of a parabola.

11. The method of claim 1, wherein said step of redirecting comprises:

arranging a plurality of second internal lens surfaces to reflect said first portion, each of said plurality of second internal lens surfaces radially separated from an adjacent of said plurality of second internal lens surfaces, each of said plurality of second internal lens surfaces having an angular orientation relative to said second direction such that said first portion is reflected generally perpendicular to said second direction and generally parallel to said first direction.

12. A warning light assembly comprising:

an array of LED light sources, each LED generating diverging light;

an integrally formed lens member defining:

a plurality of collimators positioned to receive the diverging light generated by a corresponding one of the LEDs and convert said diverging light into a substantially collimated beam having a first direction;

a first internal lens surface arranged to divert part of at least one of said collimated beams in a second direction by reflection within the lens, said second direction being substantially perpendicular to said first direction;

a second internal lens surface arranged to receive and redirect light from said first internal lens surface in a third direction by reflection within the lens, said third direction being substantially perpendicular to said second direction and substantially parallel to said first direction;

wherein light redirected by said second internal lens surface is emitted from said lens member radially spaced from said at least one of said collimated beams.

13. The warning light assembly of claim 12, wherein said first and second internal lens surfaces are planar.

14. The warning light assembly of claim 12, wherein said first and second internal lens surfaces are curved.

15. The warning light assembly of claim 12, wherein said first internal lens surface comprises a plurality of first internal lens surfaces separated by lens portions that permit part of the at least one of said collimated beam to be emitted from said lens member without being diverted from said first direction.

16. The warning light assembly of claim 12, wherein said second internal lens surface comprises a plurality of second internal lens surfaces, each of said plurality of second internal lens surfaces being radially separated from the other of said plurality of second internal lens surfaces.

17. A lens member for a light assembly comprising a plurality of light sources generating divergent light, said lens member comprising:

a collimator arranged to receive the divergent light from a light source and convert said divergent light into a substantially collimated beam by internal reflection, said substantially collimated beam having a first direction and a first position relative to the light source; and a light pipe comprising:

a first internal lens surface arranged to divert a portion of the substantially collimated beam from said first direction into a second direction;

a second internal lens surface arranged to redirect light from said first internal lens surface into a third direction; and a lens portion for transmission of light from said first internal lens surface to said second internal lens surface, wherein said light redirected by said second internal lens surface is emitted from said lens member at a second position radially spaced from said first position.

18. The lens member of claim 17, comprising a collimator and light pipe for each of said plurality of light sources.

19. A method for shifting the apparent position of light generation in a light assembly, said light assembly comprising a light source generating divergent light and having an optical axis, said method comprising:

collimating the diverging light from said light source into a substantially collimated beam substantially symmetrically arranged about said optical axis and having a first direction substantially parallel to said optical axis;

arranging a first lens surface to divert a portion of said substantially collimated beam from said first direction into a second direction;

transmitting said portion radially relative to said optical axis; and arranging a second lens surface to redirect said portion into a third direction, wherein said portion is emitted from said light assembly at a position radially displaced from said optical axis.

* * * * *